US008621762B2

(12) United States Patent
Beckett

(10) Patent No.: US 8,621,762 B2
(45) Date of Patent: Jan. 7, 2014

(54) FORCED AIR COAT HANGER

(76) Inventor: Joel Beckett, Mercer Island, WA (US)

( * ) Notice: Subject to any disclaimer, the term of this patent is extended or adjusted under 35 U.S.C. 154(b) by 463 days.

(21) Appl. No.: 12/732,622

(22) Filed: Mar. 26, 2010

(65) Prior Publication Data

US 2011/0072682 A1 Mar. 31, 2011

Related U.S. Application Data

(60) Provisional application No. 61/163,632, filed on Mar. 26, 2009.

(51) Int. Cl.
*F26B 13/00* (2006.01)

(52) U.S. Cl.
USPC ..... 34/90; 34/104; 34/105; 211/85.7; 223/85; 8/137; 68/28; 134/13; D32/8

(58) Field of Classification Search
USPC ..... 34/60, 90, 104, 105, 201, 210, 218; 211/85.7, 85.3; 223/85, 61; 8/137, 159; 68/28, 200; 134/17; D32/8
See application file for complete search history.

(56) References Cited

U.S. PATENT DOCUMENTS

| | | | | | |
|---|---|---|---|---|---|
| 2,027,894 | A * | 1/1936 | Alcorn et al. | ..... | 118/58 |
| 2,214,923 | A * | 9/1940 | Glover, Jr. | ..... | 223/51 |
| 2,378,565 | A * | 6/1945 | Locke et al. | ..... | 223/67 |
| 2,543,413 | A * | 2/1951 | Koth | ..... | 223/67 |
| 3,021,606 | A * | 2/1962 | Carpenter et al. | ..... | 34/103 |
| 3,333,747 | A * | 8/1967 | Glover, Jr. | ..... | 223/70 |
| 5,419,469 | A * | 5/1995 | Urso | ..... | 223/70 |
| 5,862,606 | A * | 1/1999 | Jannach | ..... | 34/106 |
| 6,796,053 | B2 * | 9/2004 | Lurie | ..... | 34/104 |
| 2006/0226177 | A1 * | 10/2006 | McJunkin | ..... | 223/85 |
| 2011/0072682 | A1 * | 3/2011 | Beckett | ..... | 34/621 |
| 2011/0073625 | A1 * | 3/2011 | Beckett | ..... | 223/88 |
| 2012/0186098 | A1 * | 7/2012 | Williams | ..... | 34/240 |

OTHER PUBLICATIONS http://www.amazon.com/UK-Hang-Air-Wetsuit-Dryer/dp/B0011G1F8S, Jan. 2011.

* cited by examiner

*Primary Examiner* — Steve M Gravini

(57) ABSTRACT

A multiple garment drying apparatus for drying garments that includes a hot air source and blower assembly attached to a garment hanging assembly that includes two upward extending hot air transfer tubes that connect to two hot air ports on the blower assembly. Attached to the ends of the two tubes is a hollow, transverse brace with two upward extending end brackets attached to its opposite ends. Attached to the two end brackets is an upper shoulder component used to support a jacket placed thereon. The upper shoulder component includes a plurality of air vents that enable air delivered below the upper shoulder component to travel upward and through the upper shoulder component. During operation, air from the hot air source and blower assembly is delivered to the two transfer tubes. The air from the two transfer tubes is then transmitted to the transverse brace and through the upper shoulder component.

4 Claims, 3 Drawing Sheets

FORCED AIR COAT HANGER

This utility patent application is based on and claims the benefit of U.S. provisional patent application Ser. No. 61/163,632, filed on Mar. 26, 2009.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to hot air dryers used to quickly dry garments, such as pants, jackets, shirts, sweaters, mittens, shoes and boots.

2. Description of the Related Art

Hot air dryers are commonly used to individually dry shoes, boots, gloves, mittens. Unfortunately, when one of these items is wet and need drying, other garments worn by the individual are also wet and need drying. Therefore, hot air dryers that simultaneously dry different types of items and garments are needed.

Many garments, such as jackets, vests, and sweaters are made of multiple layers of material that can become wet. Such garments when wet, are also heavy. In order to dry them thoroughly, the garments must be evenly spread out on a surface so that air may circulate around and through the wet layers. In some instances, it is important that all of the wet layers in the garment be dried out in a relatively short time period (i.e. overnight).

The outside layer on a jacket or coat is usually made of water resistant material that impedes movement of moisture into and out of the jacket's inner layers. The inside layers are often made of thick, insulating material while the jacket's inner layer is made of non-abrasive, absorbent material. When the jacket or coat is hung-up to dry overnight, the outside and inside layers usually dry in a few hours while the inner layers and seams may be damp the next morning.

In some instances, hooks and shower bars are not available for hanging wet garments. Therefore, dryers that are self supporting and can hold multiple wet garments would be desirable.

Accordingly, it is an object of the present invention to provide a portable, garment drying apparatus that can individually support and uniformly dry multiple different kinds of items and garments in a quick manner.

SUMMARY OF THE INVENTION

The foregoing objects are achieved by the garment drying apparatus disclosed herein that includes a lower base with an air source and blower assembly mounted thereon and attached to a multiple garment hanging assembly. Disposed between the lower base and the multiple garment hanging assembly are two upward extending hollow air transfer tubes that deliver air from the base to the multiple garment hanger assembly.

The multiple garment hanger assembly includes a hollow transverse brace with two upward extending outer end brackets perpendicularly aligned and attached thereto. The transverse brace may be used to hold a folded pair of pants or a hanger. Attached to the upper ends of the two end brackets is an upper shoulder component used to support an unfolded jacket or coat. The upper shoulder component is similar to the hanger that holds the jacket in a natural expanded, hung position for maximum air circulation. The upper shoulder component includes a plurality of air vents and a center opening that enables air delivered below the upper shoulder component to travel upward and through the upper shoulder component and contact the inside surfaces of garments supported thereon.

During operation, the lower base with the hot air source and blower assembly is relatively heavy and acts as a ballast to hold the two air transfers tubes in a vertical upright position. The two air transfer tubes are relatively long so that a pair of pants may be folded over and hung over the transverse brace. Because the transverse brace includes vents, hot air is able to flow upward into the space created between the transverse brace and the upper shoulder component. Further, the air vents created in the upper shoulder component enable air to travel through the upper shoulder component and contact the inside surface of the jacket or sweater hung over the upper shoulder component so that all layers in the jacket of sweater are uniformly dried.

DESCRIPTION OF THE PREFERRED EMBODIMENT(S)

Figure 1:
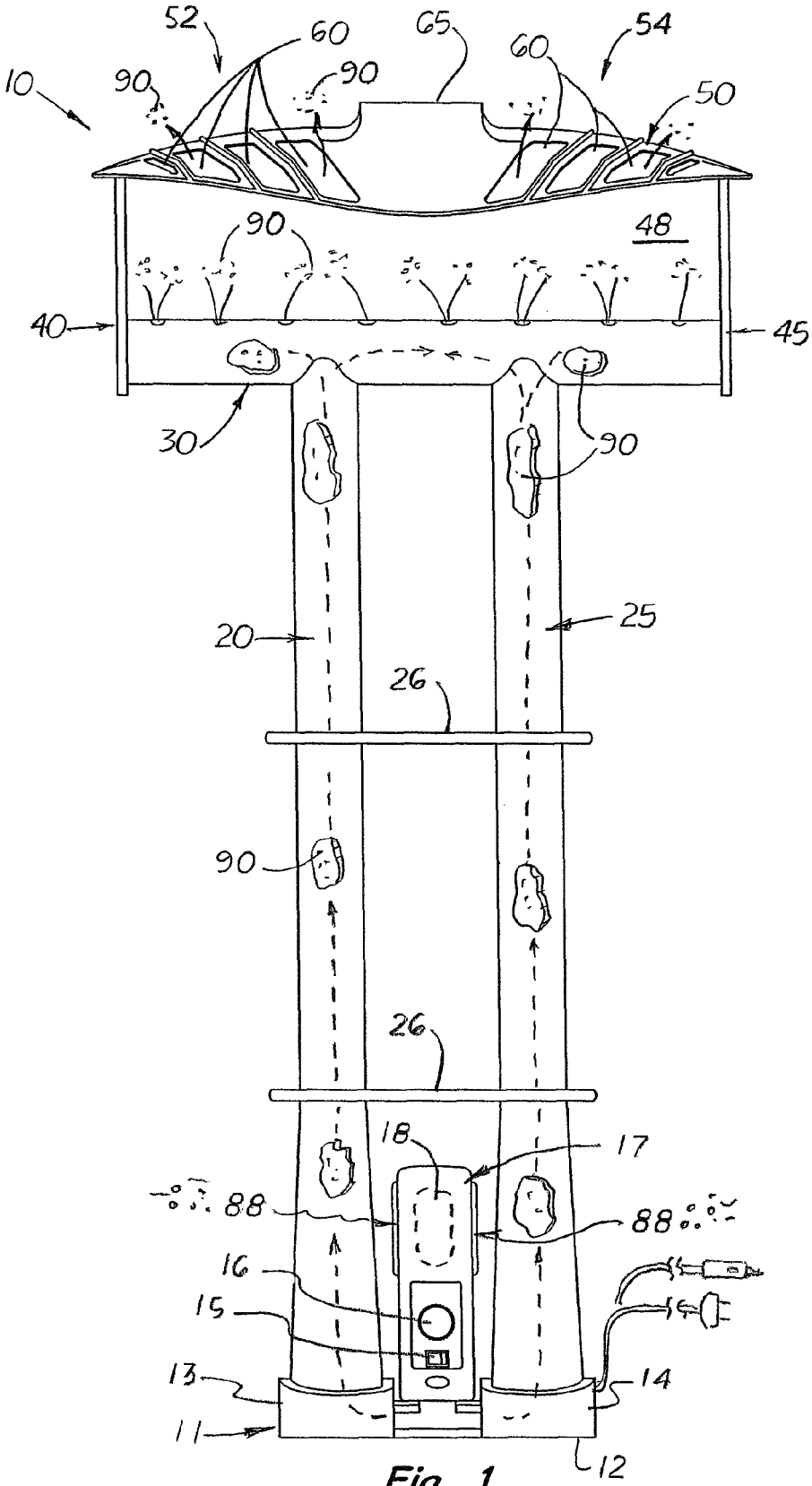
FIG. 1 is a front elevational view of the garment hanger hot air dryer.
Figure 2:
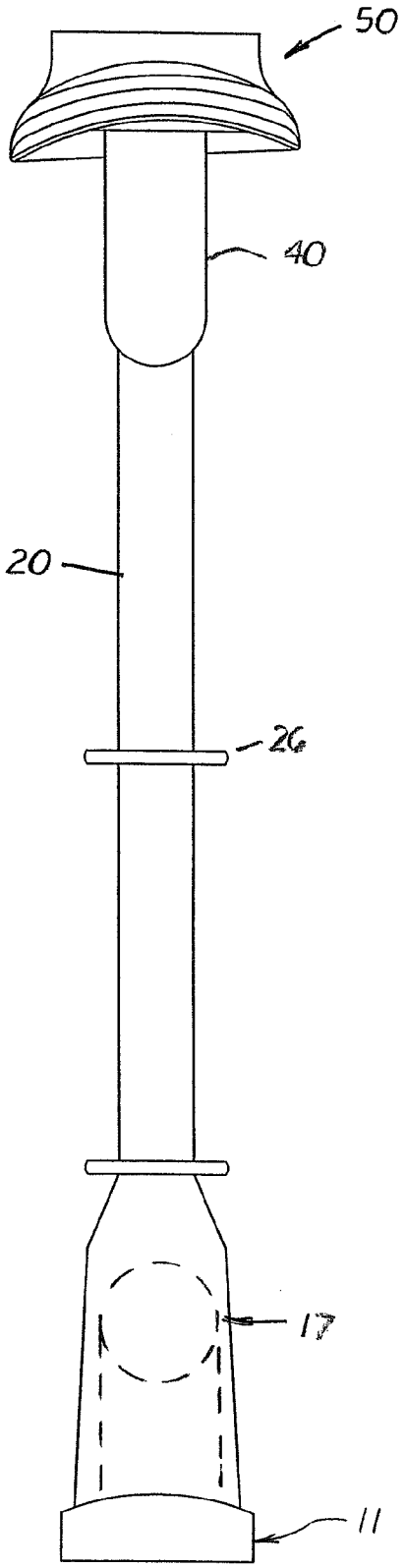
FIG. 2 is a side elevational view of the invention.
Figure 3:
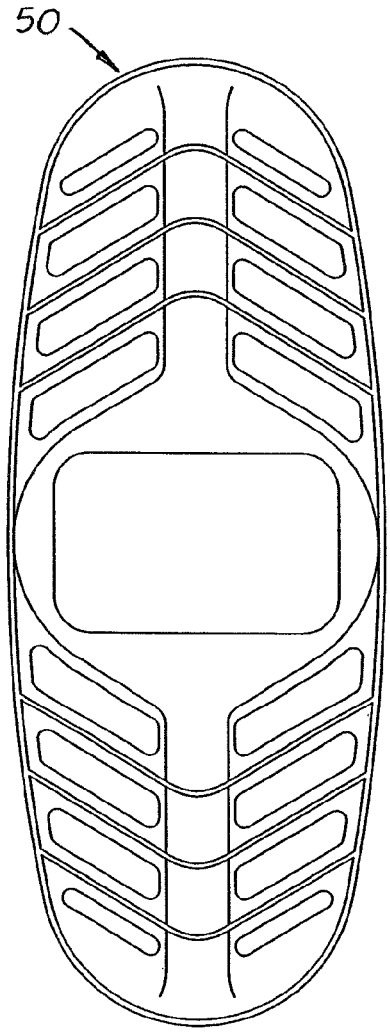
FIG. 3 is a top plan view of the upper shoulder component.

Referring to the FIGS. 1-4, there is shown a garment hanger drying apparatus 10 that includes a lower base 11 with a combination electric hot air source and blower assembly 17 mounted thereon. Attached to the base 11 are two hollow, upward extending hot air transfer tubes 20, 25. Perpendicularly aligned and attached to the ends of the two air transfer tubes 20, 25 is a hollow transverse hollow brace 30 with two upward extending outer end brackets 40, 45. The two end brackets 40, 45 are perpendicularly aligned and attached to an upper shoulder component 50 suspended in a parallel, elevated location above the transverse brace 30.

The lower base 11 has a bottom flat surface 12 that allows the apparatus 10 to be supported on a flat surface. The base 11 is hollow and includes two ports 13, 14 that connect to the lower ends of the two air transfer tubes 20, 25. Mounted centrally on the base 11 is an electric hot air source and blower assembly 17. The hot air source and blower assembly 12 may be connected to a suitable D.C. current battery source or to a suitable A.C. current electrical source. The electric hot air source and blower assembly 17 may include a main ON-OFF switch 15 that controls an internal fan and heater and a heater thermostat switch 16 that regulates operation of the internal heater 18. It should be understood, that the hot air source 18 is not a required component and that the lower base 11 may include the air blower only. The lower base 11 is made of PVC and measures approximately 12 inches in length, and 6 inches in width. When assembled, the lower base 11 with the air source and blower assembly 17 mounted thereon weighs approximately 2 to 4 lbs and acts as a ballast to hold the apparatus 10 inch an upright position on a support surface.

The upper shoulder component 50 is used to support an expanded jacket or sweater placed thereon. The upper shoulder component 50 includes a right shoulder extension 52 and a left shoulder extension 54. Formed on the two extensions 52, 54, are plurality of air vents 60 that enable air 90 delivered below the upper shoulder component 50 to travel upward and through the right and left shoulder extensions 52, 54.

During operation, fresh air 88 is pulled into the side air vents formed on the hot air source and blower assembly 17. The fresh air 88 is heated and forced upward through two outlet ports 13 and 14 formed on the lower base 11. Attached to the two ports 13, 14 are two air transfer tubes 20, 25. The air transfer tubes 20, 25 may be made up of single tube structures components or multiple tube sections. Support ties 26 may be used to hold the air transfer tubes 20, 25 in parallel alignment. The air transfer tubes 20, 25 are made of PVC and measure 1 to 2 inches in diameter and 24 to 48 inches in length.

Figure 4:
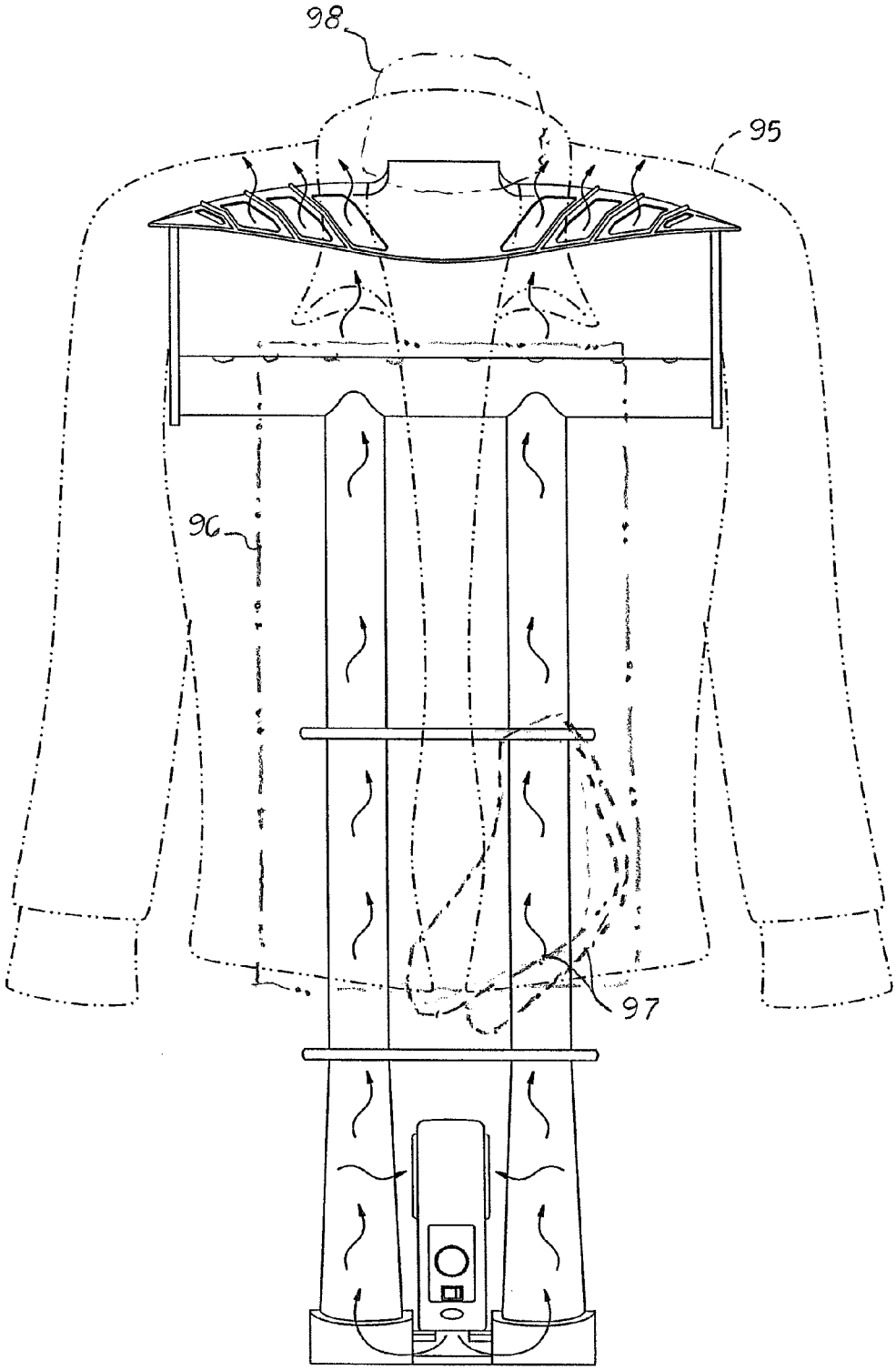
FIG. 4 is a front elevational view of the portable multiple garment hot air dryer showing a jacket hung over the upper shoulder component and being dried.

Air 90 from the air blower 17 and inside the two transfer tubes 20, 25 is then transmitted to the hollow transverse brace 30. Air 90 delivered to the transverse brace 30 is then able to flow upward into the space 48 located above the transverse brace 30. The transverse brace 30 is made of PVC and measures approximately 16 inches in length and 1-½ to 2 inches in diameter. A plurality of air vents 47 are formed on the top surface of the transverse brace 30 that allow air 90 to escape from the transverse brace 30 and flow upward towards the upper shoulder component 50. The end brackets 40, 45 attached to the ends of the transverse brace 30 are flat surfaces approximately 4 to 6 inches in length thereby holding the upper shoulder component 50 in a suspended, parallel position 4 to 6 inches above the transverse brace 30. The upper shoulder component 50 includes vents 60 that allow air 90 delivered from the brace 30 to travel through the upper shoulder component 50 and contact the inside surface of the jacket 95 or sweater hung over the upper shoulder component 50 as shown in FIG. 4. A center opening 65 is formed in the upper shoulder component 50 that allows air to flow upward and contact a hat 98 that may be placed thereon. FIG. 4 also shows a pair of pants folded over the transverse brace 30. The upper shoulder component 50 is made of PVC and measures approximately 16 to 20 inches in length, 4 to 6 inches width, and 2 to 4 inches in height.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A garment hanger hot air drying apparatus comprising:

a. a hollow lower base;

b. a hot air source and blower assembly attached to said lower base;

c. two straight, vertically aligned hollow air tubes attached to and extending upward from said lower base, said air tubes configured to transfer air from said hot air source and blower assembly;

d. a hollow, horizontally aligned transverse brace located above and attached to the ends of said air tubes opposite said lower base, said transverse brace includes a plurality of air vents formed thereon that allow air delivered from said air tubes to escape upward into an air space located above;

e an upper shoulder component configured to support an upright vertically hung jacket or sweater, said upper shoulder component includes two opposite shoulder components each with air vents that allow air locate under said upper shoulder component to flow upward and contact a jacket or sweater hung over said upper shoulder component; and, f. two end brackets attached to said transverse brace, said end brackets extending upward from said transverse brace and supporting said upper shoulder component in an elevated location above and parallel to said transverse brace thereby creating an air space between said transverse brace and said upper shoulder component.

2. The apparatus as recited in claim 1 further including said upper shoulder component with a center opening located between said opposite shoulder components.

3. The apparatus as recited in claim 1 wherein said air transfer tubes are spaced apart and supported by support ties.

4. The apparatus as recited in claim 1 wherein said lower base is configured to be supported on a flat surface with two upward extending ports that connect to said air transfer tubes.

* * * * *